US008851175B2

(12) United States Patent
Onadeko et al.

(10) Patent No.: US 8,851,175 B2
(45) Date of Patent: Oct. 7, 2014

(54) INSTRUMENTED DISCONNECTING TUBULAR JOINT

(75) Inventors: Olugbenga Adebola Onadeko, Sugar Land, TX (US); Luis Ochoa, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 830 days.

(21) Appl. No.: 12/582,539

(22) Filed: Oct. 20, 2009

(65) Prior Publication Data

US 2011/0088903 A1 Apr. 21, 2011

(51) Int. Cl.

| | |
|---|---|
| ***E21B 31/00*** | (2006.01) |
| ***E21B 17/06*** | (2006.01) |
| ***E21B 47/09*** | (2012.01) |

(52) U.S. Cl.

CPC ..... *E21B 47/09* (2013.01); *E21B 17/06* (2013.01); *E21B 31/00* (2013.01)

USPC ..... 166/301

(58) Field of Classification Search

CPC ..... E21B 17/06; E21B 31/03; Y10S 285/922

USPC ..... 166/301, 351

See application file for complete search history.

(56) References Cited

U.S. PATENT DOCUMENTS

| | | | | |
|---|---|---|---|---|
| 2,000,716 A | | 5/1935 | Polk | |
| 2,096,359 A | | 10/1937 | Hawthorn | |
| 2,140,537 A | | 12/1938 | McNally et al. | |
| 2,670,927 A | * | 3/1954 | Edwards | 166/301 |
| 2,905,437 A | * | 9/1959 | Bell et al. | 166/299 |
| 3,597,118 A | | 8/1971 | Kolfertz | |
| 3,807,502 A | | 4/1974 | Heilhecker et al. | |
| 4,095,865 A | | 6/1978 | Denison et al. | |

(Continued)

FOREIGN PATENT DOCUMENTS

| | | |
|---|---|---|
| RU | 2040691 | 7/1995 |
| WO | 90/14497 | 11/1990 |
| WO | 2004/033847 | 4/2004 |
| WO | 2004/085796 | 10/2004 |

OTHER PUBLICATIONS

MacDonald, "Four Different Systems Used For MWD," Oil & Gas Journal, pp. 115-124, Apr. 3, 1978.

*Primary Examiner* — Shane Bomar
*Assistant Examiner* — Kipp Wallace
(74) *Attorney, Agent, or Firm* — Chadwick A. Sullivan; Brigitte Echols

(57) ABSTRACT

A method and equipment for an instrumented tubular joint apparatus for use in a pipe string comprising an upper tubular section with a threaded connection thereabove and an axial passage for fluid to flow through connected to a lower tubular section with a threaded connection therebelow and an axial passage for fluid to flow through, a sensor to measure strain at the instrumented tubular joint, a data recording and transmitting unit operatively connected to the sensor, means to relate the data acquired by the sensor to a surface processing unit; and a mechanism to disconnect the upper section from the lower section after receiving a signal from the surface processing unit. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

12 Claims, 9 Drawing Sheets

(56) References Cited

U.S. PATENT DOCUMENTS

| | | | | |
|---|---|---|---|---|
| 4,126,848 | A | 11/1978 | Denison | |
| 4,359,898 | A | 11/1982 | Tanguy et al. | |
| 4,361,193 | A | 11/1982 | Gravley | |
| 4,364,587 | A | 12/1982 | Samford | |
| 4,605,268 | A | 8/1986 | Meador | |
| 4,722,402 | A | 2/1988 | Weldon | |
| 4,806,928 | A | 2/1989 | Veneruso | |
| 4,901,069 | A | 2/1990 | Veneruso | |
| 4,953,636 | A | 9/1990 | Mohn | |
| 5,052,941 | A | 10/1991 | Hernandez-Marti et al. | |
| 5,278,550 | A | 1/1994 | Rhein-Knudsen et al. | |
| 5,375,098 | A | 12/1994 | Malone et al. | |
| 5,448,911 | A | 9/1995 | Mason | |
| 5,517,464 | A | 5/1996 | Lerner et al. | |
| 5,531,592 | A | 7/1996 | Tasi | |
| 5,624,051 | A | 4/1997 | Ahern, Jr. et al. | |
| 5,971,072 | A | 10/1999 | Huber et al. | |
| 6,392,317 | B1 | 5/2002 | Hall et al. | |
| 6,641,434 | B2 | 11/2003 | Boyle et al. | |
| 6,799,632 | B2 | 10/2004 | Hall et al. | |
| 6,866,306 | B2 | 3/2005 | Boyle et al. | |
| 7,004,252 | B2 | 2/2006 | Vise, Jr. | |
| 7,253,745 | B2 | 8/2007 | Hall et al. | |
| 7,316,277 | B2 | 1/2008 | Jeffryes | |
| 7,397,388 | B2 | 7/2008 | Huang et al. | |
| 7,503,398 | B2 * | 3/2009 | LoGiudice et al. | 166/386 |
| 7,556,104 | B2 | 7/2009 | Jeffryes | |
| 2004/0119607 | A1 | 6/2004 | Davies et al. | |
| 2005/0284663 | A1 | 12/2005 | Hall et al. | |
| 2006/0151179 | A1 | 7/2006 | Williams et al. | |
| 2007/0159351 | A1 | 7/2007 | Madhavan et al. | |
| 2008/0041597 | A1 * | 2/2008 | Fisher et al. | 166/381 |
| 2008/0314587 | A1 * | 12/2008 | Del Campo et al. | 166/264 |
| 2010/0051271 | A1 * | 3/2010 | Gano et al. | 166/278 |

* cited by examiner

301

302

303

304

INSTRUMENTED DISCONNECTING TUBULAR JOINT

FIELD OF DISCLOSURE

The present application is generally related to the use of a sub in a pipe to measure strain and disconnect a section of a pipe as required, and more particularly to methods and apparatus associated with the surface operation of a sub located along the length of a pipe such as, for example a drill pipe, that can monitor strain and is capable to disconnect a section of pipe located below said sub. Novel methods and systems to achieve stress and environment data measurement, circulation, push away from the borehole wall and disconnection of a section of a pipe as required will also be discussed in the present disclosure by ways of several examples that are meant to illustrate the central idea and not to restrict in any way the disclosure.

BACKGROUND OF DISCLOSURE

Wellbores are drilled to locate and produce hydrocarbons. A downhole drilling tool with a bit at the lower end thereof is advanced into the ground to form a wellbore. As the drilling tool is advanced, a drilling mud is pumped from a surface mud pit, through the drilling tool and out through the drill bit to cool the drilling tool and carry away cuttings. The fluid exits the drill bit and flows back up to the surface for recirculation through the tool. The drilling mud is also used to form a mudcake to line the wellbore.

To drill a well that sometimes extends to several thousands of feet, is often challenged with many obstacles like sticking, blow outs, mud losses, caving, key seating, just to name a few. One common undesired and certainly very costly issue faced by the industry when drilling and completing a well is having the pipe (drill pipe, work pipe, casing, tubing, etc) stuck in the well. There are several reasons why a pipe will get stuck in the well: it could be that a drill pipe is stuck in the wellbore due to key seating when the drill bit relatively sharply deviates from the projected course of the well creating a hard turn on the well profile where a relatively rigid string as the drill pipe is can get stuck or wedged; there is also what is commonly known in the industry as differential sticking when the drill pipe removes the filter cake formed around the wellbore exposing a sufficiently permeable formation where the differential pressure between the wellbore and the formation is sufficiently large to get the pipe stuck along the area in contact with the permeable formation as the pressures try to balance itself; the pipe could be simply mechanical stuck by something dropped down the wellbore; as described above the wellbore is drilled by removing and transporting cuttings (pieces of formation cut by the drilling bit to bore the wellbore) to surface, if the transport to surface of the cuttings is insufficient the accumulation of cutting down the wellbore can eventually form a plug (pack-off) and get the pipe stuck; it is not infrequent that the pipe gets stuck due to a malfunctioning equipment, as for example, a packer that wont release or a casing cement job gone wrong where the cement reaches the pipe's annulus. The above examples are just a few of the reasons why a pipe, of any kind, lowered down a wellbore can get stuck with costly consequences. It is for these reasons that a pipe stuck in the wellbore is of great concern for the industry. A practical way to safely assist in the recovery of a stuck pipe will undoubtedly result in great cost savings for the industry.

Furthermore, with the pursuit of ever deeper and more complex reservoirs the issue of stuck pipe becomes more and more provable and exponentially costly. An example of this is the extreme pressure differentials commonly seen in deep water wells, the complexities of drilling close to a salt dome, the increase of drilling extended reach wells or the new downhole tools designed to drill long horizontal wellbores following the ups and downs of a formation not wider than a couple of tens of feet. The reason why we can now go after these widely different portfolio of hard to reach reservoirs lies in technology, new LWD (Logging While Drilling) tools, new ways to communicate to the downhole drilling tools, new downhole motors, new designs of pipes, etc. As the technology evolves so does the cost of the apparatus lowered downhole to be able to reach these complex reservoirs. Not more than a couple of decades ago the drilling string consisted of a drill bit, some drill collars, heavy weight collars, stabilizers and a jar; now a days the cost of the downhole tools trusted with the task of drilling a wellbore can easily reach millions of dollars. Not only have the downhole tools evolved from chunks of metal to hi end computerized equipment, also the drill pipe has seen its share of improvements in order to cope with increasing power consumption of downhole tools and the demand for faster data transfer between the surface and the downhole tools, the modern pipe is evolving to enable the delivery of power and as a conduit for high speed data transfer. Such improvements can be found in U.S. Patent Application Publication No. 2007/0159351 by Madhavan et al. published Jul. 12, 2007 and filed Nov. 28, 2006. The modernization of the drill pipe will increase even further the total cost of equipment lowered in the wellbore.

As briefly described above during the drilling operation, it is desirable to provide communication between the surface and the downhole tool. Wellbore telemetry devices are typically used to allow, for example, power, command and/or communication signals to pass between a surface unit and the downhole tool. These signals are used to control and/or power the operation of the downhole tools and send downhole information to the surface.

Several different types of telemetry systems have been developed to pass signals between the surface unit and the downhole tool. For example, mud pulse telemetry systems use variations in the flow of mud passing from a mud pit to a downhole tool and back to the surface to send decodable signals. Examples of such mud pulse telemetry tools may be found in U.S. Pat. Nos. 5,375,098 and 5,517,464. In addition to mud pulse wellbore telemetry systems, other wellbore telemetry systems may be used to establish the desired communication capabilities. Examples of such systems may include a drill pipe wellbore telemetry system as described in U.S. Pat. No. 6,641,434, an electromagnetic wellbore telemetry system as described in U.S. Pat. No. 5,624,051, and an acoustic wellbore telemetry system as described in PCT Patent Application Publication WO 2004/085796. Other data conveyance or communication devices, such as transceivers coupled to sensors, have also been used to transmit power and/or data. Depending on the wellbore conditions, data transmission rates and other factors, it may be preferable to use certain types of telemetry over the others for certain operations.

In particular, drill pipe telemetry has been used to provide a wired communication link between a surface unit and the downhole tool. The concept of routing a wire in interconnected drill pipe joints has been proposed, for example, in U.S. Pat. No. 4,126,848 by Denison; U.S. Pat. No. 3,957,118 by Barry et al.; and U.S. Pat. No. 3,807,502 by Heilhecker et al.; and in publications such as "Four Different Systems Used for MWD", W. J. McDonald, The Oil and Gas Journal, pages 115-124, Apr. 3, 1978. A number of more recent patents and publication have focused on the use of current-coupled inductive couplers in wired drill pipe (WDP) as described, for example, in U.S. Pat. Nos. 4,605,268; 2,140,537; 5,052,941; 4,806,928; 4,901,069; 5,531,592; 5,278,550; 5,971,072; 6,866,306 and 6,641,434; Russian Federation published Patent Application No. 2040691; and PCT Application Publication No. WO 90/14497. A number of other patent references have disclosed or suggested particular solutions for data transmission along the axial lengths of downhole conduit or pipe joints, such as U.S. Pat. Nos. 2,000,716; 2,096,359; 4,095,865; 4,722,402; 4,953,636; 6,392,317; 6,799,632 and US Patent Application Publication 2004/0119607; and PCT Application Publication Nos. WO 2004/033847 and WO 02/06716. Some techniques have described a wire positioned in a tube and placed inside a drill collar as shown, for example, in U.S. Pat. No. 4,126,848.

A description of a mechanism that might be used to release a pipe joint is described in the U.S. Pat. No. 4,364,587 issued to Travis L. Samford on Dec. 21, 1982 and herein incorporated by reference. An example of sensors used in the industry to measure strain in a drill pipe assembly, are described in the U.S. Pat. No. 7,316,277 issued to Benjamin Peter Jeffryes on Jan. 8, 2008 and U.S. Pat. No. 4,359,898 issued to Denis R. Tanguy et al. issued on Nov. 23, 1982; both U.S. patents assigned to Schlumberger Technology Corporation and herein incorporated by reference. Similarly a description of a used method for recording and transmitting a measurement done downhole can be found in U.S. Pat. No. 7,556,104 issued to Benjamin Peter Jeffryes on Jul. 7, 2009, assigned to Schlumberger Technology Corporation and herein incorporated by reference. A description of an example of the means used in the industry to circulate a desired fluid to and from the inside of a tubular to the annulus can be found in U.S. Pat. No. 7,004,252 issued to Charles E. Vise Jr on Feb. 28, 2006, assigned to Schlumberger Technology Corporation and herein incorporated by reference. An example of a mechanism used to push a tubular away from a borehole wall can be found in U.S. Patent Application No. US2008/0314587 filed by Christopher del Campo et all, filed on Jun. 21, 2007 published on Dec. 25, 2008; assigned to Schlumberger Technology Corporation and herein incorporated by reference.

As the communication to and from downhole and surface can be easily established by today methods as described above, a novel monitoring and disconnecting instrumented joint can be used to avoid a stuck pipe and in the event the pipe does get stuck, to ultimately disconnect the free portion of the pipe string from the portion of said string that is stuck. A novel approach to circulate at different points of a pipe string through the instrumented tubular joint, the attempt to free the pipe by pushing it away from the borehole wall and ultimately the release when required of a portion of said pipe string will also be disclosed throughout this application.

SUMMARY OF THE DISCLOSURE

The mechanisms at work to get a pipe stuck are varied with the most common being pipe differentially stuck, "key seated", packed-off or mechanically stuck. Once the pipe is stuck there are but a few things the drilling rig operator can try to free the pipe: the operator may try circulating a specialty mud or may try to operate the jars downhole which essentially tries to shock the pipe free with a hammer like action or it may try rotating the pipe free; when all these has been tried without a satisfactory result there are only a few options left; these options are usually, in order: running a free point indicator tool inside the pipe to determine the depth the pipe is stuck at, punching holes in the pipe's wall to reestablish circulation if circulation is partially or totally lost, trying to back off at a joint of drill pipe or if the later fails, cutting the pipe with a pipe cutter for subsequent fishing of the pipe left in the hole. All these options have pros and cons, for example punching holes in the pipe's wall will allow to reestablish circulation from that depth up but once the holes are open there is no practical way to close it; therefore, no way to circulate drilling mud deeper into the wellbore if needed, as the drilling mud will follow the path of least resistance to return to surface. In cases of barite settling down out of suspension in the drilling mud, barite being a weighting element commonly used in the drilling mud, or cuttings plugging the annulus, it is desirable to circulate from a shallower to a deeper locations within the wellbore to be able to lift those solids packing-off the pipe, something not achievable by today's commonly use methods of punching holes in the pipe. Backing off a joint of pipe has its own risks, the operation entails turning the pipe in the direction it will unscrew itself and lifting the weight of the pipe so the desired pipe joint is neither in tension nor in compression and just enough torque to "back off" the threaded connection, a person skilled in the art will recognize that achieving the task of working the torque and tension in a pipe down a wellbore several thousands feet deep is no easy task and an uncertain one at best. In theory the back off shot, which is a small explosive charge designed to shock the pipe from the inside, should deliver enough energy at the desired joint as to back it off from the treaded connection so the pipe can be disconnected; in reality this is a difficult task to achieve as there are uncertainties as to how much torque was able to be worked down and if the joint is in tension or compression, it is not uncommon that the back off operation fails to release the desired joint or even worst, the pipe unscrewing itself at a shallower depth than wanted while trying to work the torque down.

The following embodiments provide examples and do not restrict the breath of the disclosure and will describe ways to monitor strain exerted on a pipe, retrieve a portion or portions of a pipe string, to open/close circulating ports as required or means to push the pipe away from the borehole wall in order to facilitate the retrieval of a stuck pipe.

In one of the preferred embodiments at least one instrumented tubular joint apparatus for use in a pipe string comprising an upper tubular section with a threaded connection thereabove and an axial passage for fluid to flow through connected to, a lower tubular section with a threaded connection therebelow and an axial passage for fluid to flow through with a sensor to measure strain and environmental data, a data recording and transmitting unit operatively connected to the sensor, means to relate the data acquired to a surface processing unit and a mechanism to disconnect the upper section from the lower section after receiving a signal from a surface processing unit. The strain measured by the sensor comprise measuring tension, compression and torsion and the environmental data measured by the sensor comprise temperature, pressure, gas content and fluid viscosity. The lower section of the apparatus after disconnecting from the upper section may have a profile which allows a pipe or upper section of said apparatus to be reconnected to the lower section as required. The means to relate the acquired measurements to a surface processing unit are varied, the data might be transmitted by wire, wireless, acoustic or by optic data transmission means.

In a related embodiment an instrumented tubular joint apparatus as described above might further comprise a plurality of circulating ports to allow circulating fluid to and from the inside of said instrumented tubular joint; a sensor to measure fluid volume and environmental data and a mechanism to open and close said circulating ports as required after receiving a signal from a surface processing unit might be included. The fluid volumes that might be measured are the volume of fluid circulating through the circulating ports and the fluid circulating inside of the instrumented tubular joint entering at the top of the instrumented tubular sub.

A related embodiment might use different means to push the instrumented tubular joint apparatus away from the borehole wall after receiving a signal from a surface processing unit. To push the instrumented tubular joint and in doing so, the pipe, at least one piston, telescopic piston, retractable arm or inflatable bladder that extends radialy outwards from said instrumented tubular joint apparatus may be used. It is desirable that the aperture of the selected dispositive to push the instrumented tubular joint away from the borehole wall to be monitored.

The present disclosure also covers a method for disconnecting a section of a pipe by sending a signal from a surface processing unit to a disconnect mechanism located in the instrumented tubular joint apparatus to disconnect the upper section from the lower section of the instrumented tubular joint apparatus.

In a related novel herein disclosed method for disconnecting a section of a pipe comprising at least one instrumented tubular joint apparatus as described above and located along the length of a pipe, requires selecting the instrumented tubular joint apparatus to be disconnected, sending a signal from a surface processing unit to the desired instrumented tubular joint apparatus to disconnected the upper section from the lower section of the instrumented tubular joint apparatus.

A method for circulating fluid to and from the inside of a pipe is also disclosed which comprises at least one instrumented tubular joint apparatus as disclosed in any of the paragraphs above and located along the length of a pipe where an instrumented tubular joint apparatus which circulating ports are required to be open or closed is selected and further sending a signal from a surface processing unit to the desired instrumented tubular joint apparatus to open or close as desired said circulating ports; circulating a desired fluid is achieved through the circulating ports at the open position.

A method for disconnecting a section of pipe from a section of stuck drill pipe in a wellbore is also disclosed; the method comprises of at least one instrumented tubular joint apparatus as described in any of the above paragraphs located along the length of a pipe at desired intervals wherein a signal is sent from a surface processing unit to the desired instrumented tubular joint apparatus to open the circulating ports as to be able to circulate a desired fluid through the circulating ports, if desired a signal from said surface processing unit may also be sent to a particular instrumented tubular joint apparatus to disconnected the upper section from the lower section of the selected instrumented tubular joint apparatus as to free the portion of pipe above said instrumented tubular joint and be able to retrieve the freed drill pipe and upper section of the instrumented tubular joint apparatus from the wellbore.

Further features and advantages of the disclosure will become more readily apparent from the detailed description when taken in conjunction with the accompanying drawings.

DETAIL DESCRIPTION OF THE DRAWINGS

In the following detailed description of the preferred embodiments, reference is made to accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
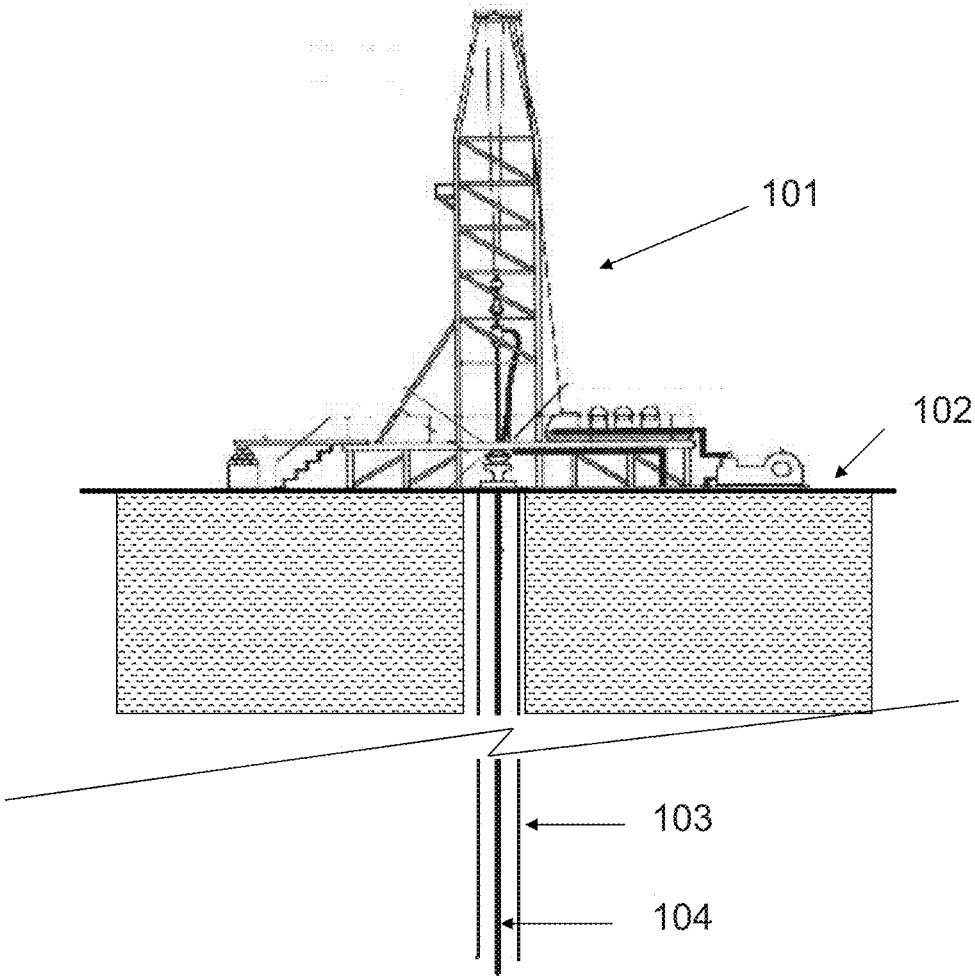
FIG. 1 shows an oil rig where the disclosed embodiment might be used

FIG. 1 shows an example of a drilling rig 101 located at surface 102, showing a cased wellbore 103 and a pipe 104 lowered inside said wellbore.

Figure 2:
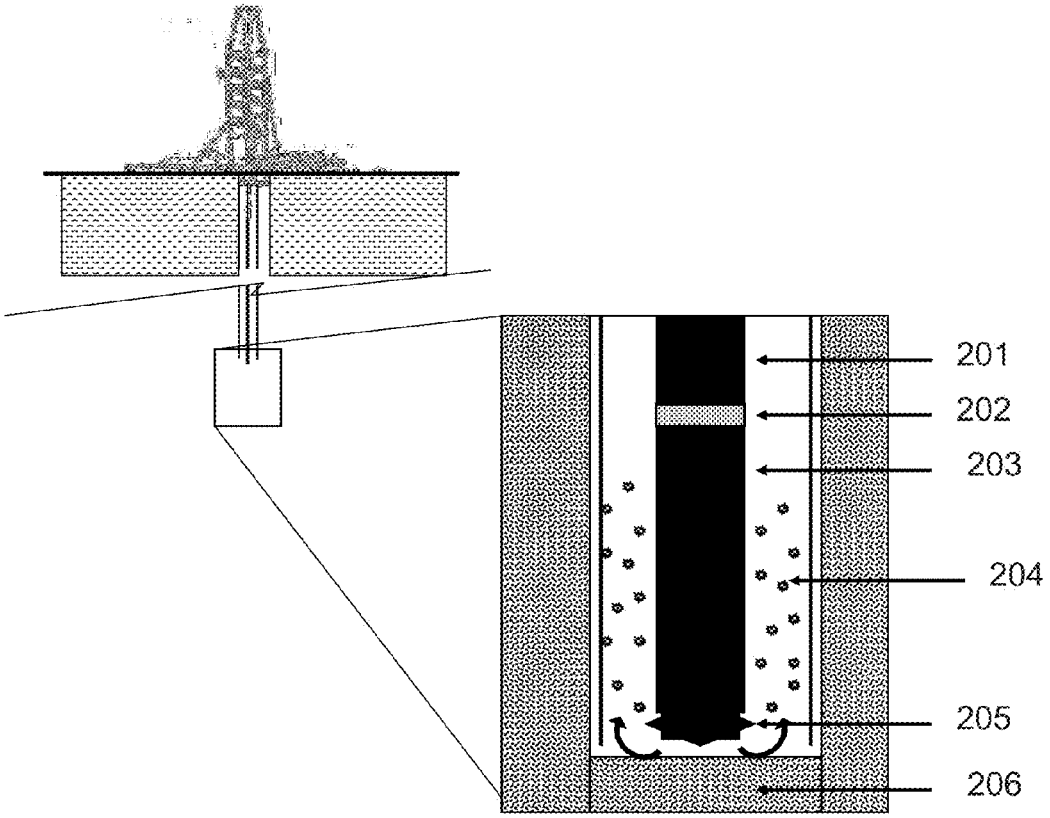
FIG. 2 shows a possible location of the instrumented tubular joint.

FIG. 2 shows an example of a possible location of the instrumented tubular joint 202 for general illustration purposes located along the length of a pipe. The figure also shows the basic principle of drilling a wellbore where a drilling bit 205 removes particles from the subsurface formation 206, said particles are called cuttings 204 and are removed by circulating drilling mud with engineered properties to be able to lift the cuttings 204 up the wellbore for surface disposal. Should the pipe get stuck below the instrumented tubular joint 202 then the release of the upper section of said instrumented tubular joint from the lower section will result in freeing the pipe portion 201 above the instrumented tubular joint and leaving in the wellbore the pipe portion 203 below the instrumented tubular joint.

Figure 3:
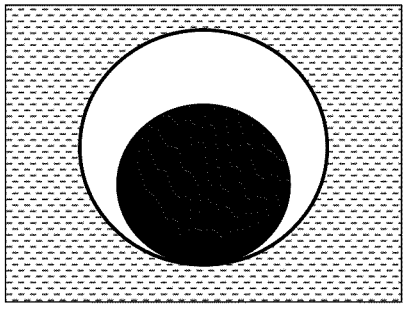
FIG. 3 shows mechanisms that might get a pipe stuck
Figure 3:
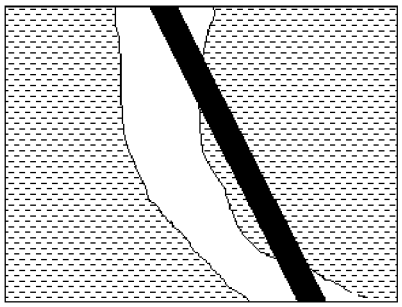
Figure 3:
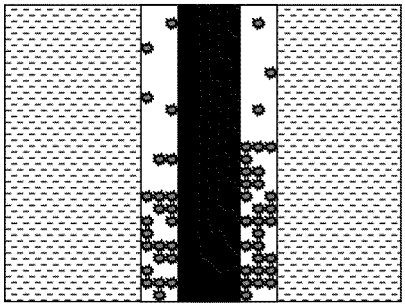
Figure 3:
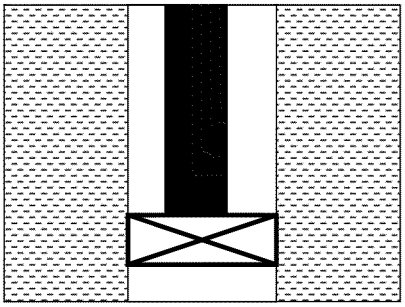

FIG. 3 shows a few of the mechanisms that might get a pipe stuck, the example shown in 301 depicts what is known in the industry as differential sticking and it happens when the pressure in the wellbore is much greater than that in the subsurface formation, combined with a relatively high permeability of said subsurface formation; as enough area of the pipe contacts the wellbore wall and the fluid in the wellbore filtrates into the subsurface formation the pipe a large differential pressure is generated resulting in the pipe getting stuck to the wellbore wall. On example 302*a* "key seating" on a "dog leg" as is known in the industry is shown, the pipe being a relatively stiff element will carve a grove into the subsurface formation in places were the radius of curvature of the drilled wellbore is small; the grove created by the travel of the pipe up and down the wellbore can get the pipe stuck. Perhaps one of the most common mechanisms causing a pipe to get stuck is packing up of sediments, usually formation cutting or weighting agents on the drilling mud such as barite settling down and forming a plug that will get the pipe stuck; the resulting plug might impede the circulating of drilling mud from the drill bit generating potentially catastrophic situations like an unstable mud column which could develop into a well blowout. Keeping the drilling mud circulating is vital to keep a well stable, that is why it is common for rig operators to shoot holes through the pipe's wall to reestablish circulation if they are unable to circulate through the pipe as a result of a plug formed as depicted in example 303, a person skill in the art will recognize that the capability to open or close as required a circulating ports located along the length of the pipe will represent an important improvement. The example shown in 304 shows a setting of a mechanical plug or packer where the release system failed to released the pipe, under this circumstances the most common solution is to use pipe cutters in order to retrieve the pipe, then a milling run is made to mill out the packer's anchors to release it from the casing and its subsequent fishing; at this point the operation has to start again from the beginning Damage to the casing is not unheard of in this type of operations.

Figure 4:
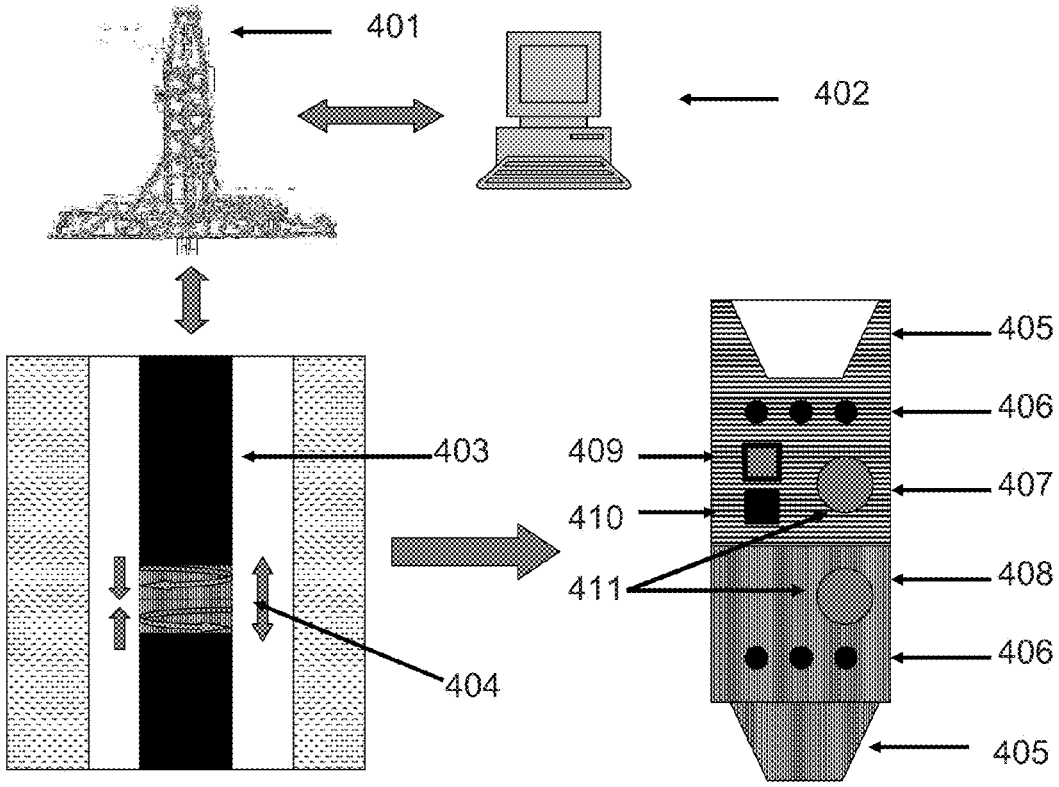
FIG. 4 shows the Sub measuring Tension, Compression, Torque and environmental data.

FIG. 4 shows one possible operation of the disclosed instrumented tubular joint 404 wherein at least one instrumented tubular joint 404 is placed along the length of a pipe 403 that is lowered into a borehole by a drilling or workover rig 401, as the borehole is drilled or the pipe is moved, the instrumented tubular joint 404 measures strain in the pipe and environmental data. As a particular instrumented tubular joint 404 moves and rotates in the borehole the strain (tension, compression and torque) exerted in the pipe is measured; other measurement such as environmental data (pressure, temperature, gas content and fluid viscosity), the movement of the mechanism 411 in use to push the instrumented tubular joint away from the borehole wall and fluid flow volumes can be obtained by the sensor package 410. All the measurements collected by the sensor package 410 are recorded in the downhole controller, data recording and transmitting unit 409 to be sent up hole to the surface processing unit 402. The transmission means from the downhole controller, data recording and transmitting unit 409 to the surface processing unit 402 may be done by wire, wireless, acoustic or optic data transmission means. The surface processing unit 402 processes the information acquired downhole, controls the operation of the circulating ports 406 in open or close position, controls the movement of the mechanism 411 in use to push the instrumented tubular joint away from the borehole wall and also controls the operation of the release assembly. The surface processing unit 402 sends as required, signals to the downhole controller, data recording and transmitting unit 409 to operate to a closed or open position the circulating ports 406, to extend or retract the mechanism 411 in use to push the instrumented tubular joint away from the borehole wall and to disconnect the upper instrumented tubular joint section 407 from the lower instrumented tubular joint section 408. The mechanism 411 used to push the instrumented tubular joint away from the borehole wall might be a piston, a telescoping piston, a retractable arm, an inflatable bladder or similar mechanism design for the purpose of pushing a tubular away from the face of a wall.

Figure 5:
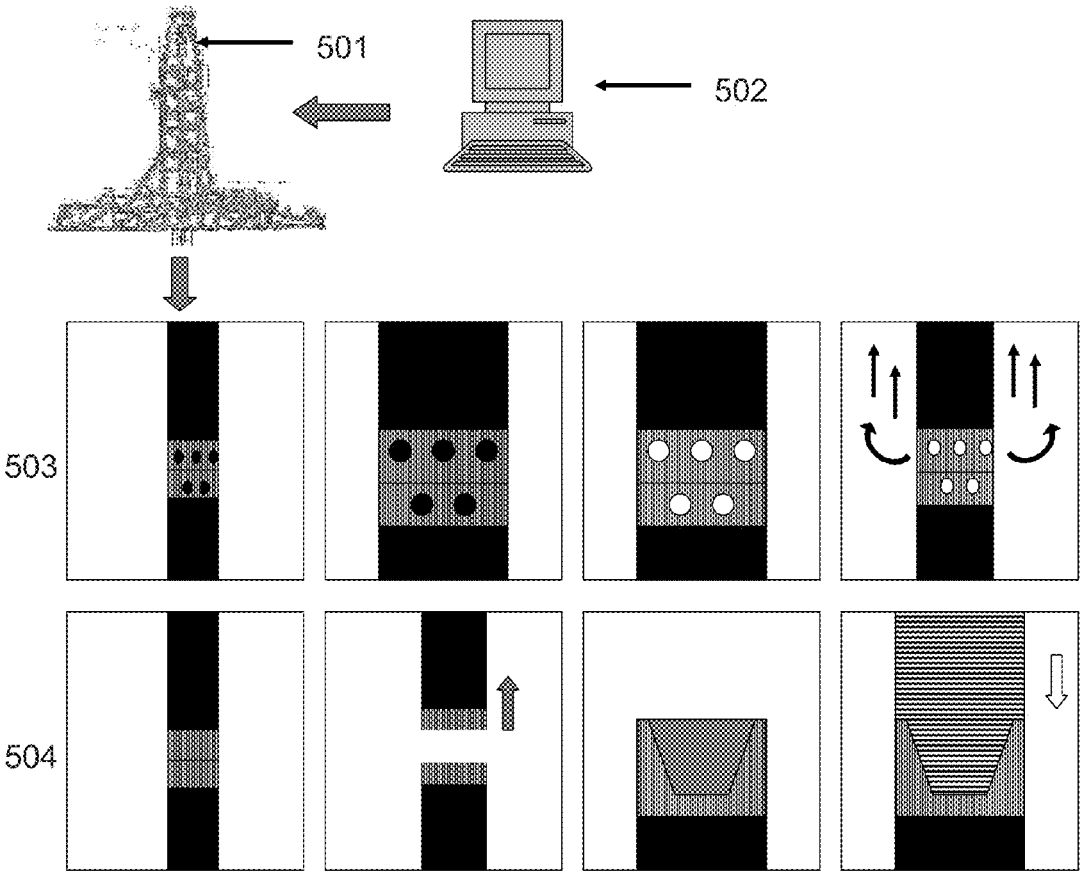
FIG. 5 shows the instrumented tubular joint operation.

FIG. 5 shows an example of the operation of one instrumented tubular joint located in the drill pipe used to drill a borehole from the drilling rig 501; while drilling the strain on the pipe at the instrumented tubular joint or joints, as multiple instrumented tubular joints can be placed along the length of the pipe, is transmitted to surface to the surface processing unit 502. In the event the pipe is becoming stock the strain in the instrumented tubular joint above the stuck point will increase while the strain below the stuck point will decrease. The increase of pressure needed to circulate fluid might be a sign of the pipe becoming stuck. The instrumented tubular joint, as described above, will send information to the surface processing unit 502 so the approximate depth of the stuck point can be determined. Once the approximate depth of the stuck point is determined, the instrumented tubular joint can be used to try and release the whole of the pipe or to ultimately free as much of the stuck pipe as possible. A possible sequence of operation is shown in FIG. 5; in sequence 503 the circulating ports in the instrumented tubular joint immediately below the stuck point can be open and circulation can be enabled from that depth, the aim is to try and lift solid material that can potentially be plugging the annulus and preventing the pipe to be retrieved, treatment fluids like fluids to control swelling clays or to reduce friction can also be pumped to that specific depth in an attempt to release the pipe. The instrumented tubular joint may comprise of volumetric sensors to record volumes of fluid pumped through the pipe and the volume of fluid that exits through the circulating ports. A person skilled in the art will recognize the advantages of the multiple combinations of treatments that can be achieved from the control from the surface processing unit 502 of open or closed circulating ports located along the length of a stuck pipe. If the stuck pipe can not be released by using the instrumented tubular joint circulating ports then the sequence of events described in 504 may be use; once the stuck point is derived from the data from the surface processing unit 502 and the decision to release the portion of the pipe that is free, a signal from the surface processing unit 502 is sent to the desired instrumented tubular joint to be activated. The instrumented tubular joint upon receiving the signal from the surface processing unit 502 will disconnect the upper instrumented tubular section from the lower instrumented tubular section thus releasing the portion of pipe located above the upper instrumented tubular section along with it. The lower instrumented tubular section, still attached to the stuck pipe, will have a profile which a subsequent work pipe can be reattached to. The novel advantage of having a profile in the lower instrumented tubular section that facilitates to be reattached to a working pipe will be obvious to a person skilled in the art, a more robust and stronger work pipe can be subsequently reattached to the stuck pipe in order to have a better chance to free it. By conventional means the pipe is often released, as described before, by the use of explosive devices that although effective to release the free portion of a pipe, creates such a blast that the remaining pipe is mangled to a degree that is, more often than not, impossible to be reattached to anything without a time consuming and expensive fishing operation.

Figure 6:
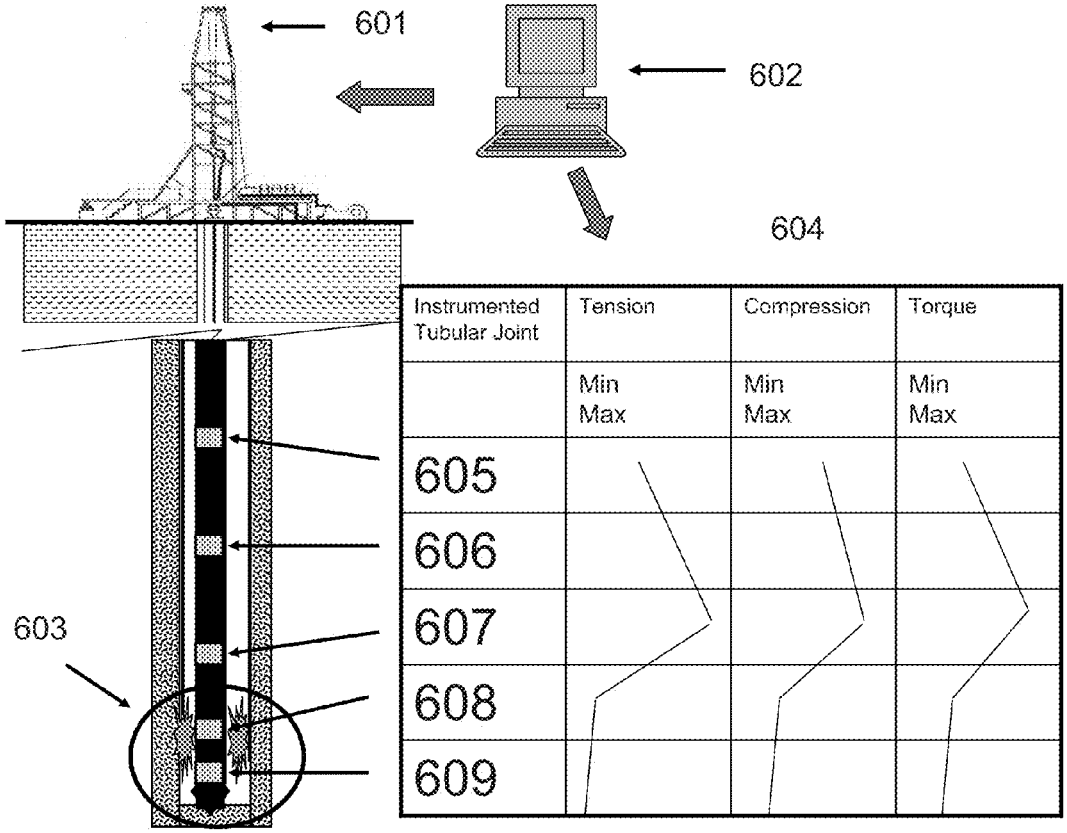
FIG. 6 shows the operation of a plurality of instrumented tubular joints.

FIG. 6 shows an example of the use of a plurality of instrumented tubular joint in a drilling or workover rig 601. The example shows the surface processing unit reading strain exerted in the pipe at different depths with a plurality of instrumented tubular joints (605-609). The disclosed example shows a stuck point 603 somewhere between the instrumented tubular joint 608 and the instrumented tubular joint 607 and the readings 604 the respective instrumented tubular joints will have if the pipe is subjected to tension, compression or torque; with this information at the surface processing unit 602, if the measurements are monitored in real time an approximate stuck point can be determined as the instrumented tubular joints start to show indications of the pipe becoming stuck, preventive measures can be implemented at this time to avoid a stuck pipe. If the pipe ultimately becomes stuck then finding a stuck point, circulating treatment fluids, pushing a determined instrumented tubular joint away from the borehole wall and if needed disconnecting the pipe might be achieved, with the use of the presently disclosed instrumented tubular joint, in a matter of minutes or hours instead of days as is currently the case. In the industry today a stuck pipe that cannot be freed by the rig crew, will be normally freed by calling a wireline, coiled tubing or slick line crew to the drilling or workover rig, usually involving the transportation of explosives to the rig site. Depending on the regulatory laws, the location of the rig and the location of the required equipment, the transportation of the personnel and equipment needed to start the operation to free a stuck pipe can vary from multiple hours in the best case scenario to days or even weeks.

Figure 7:
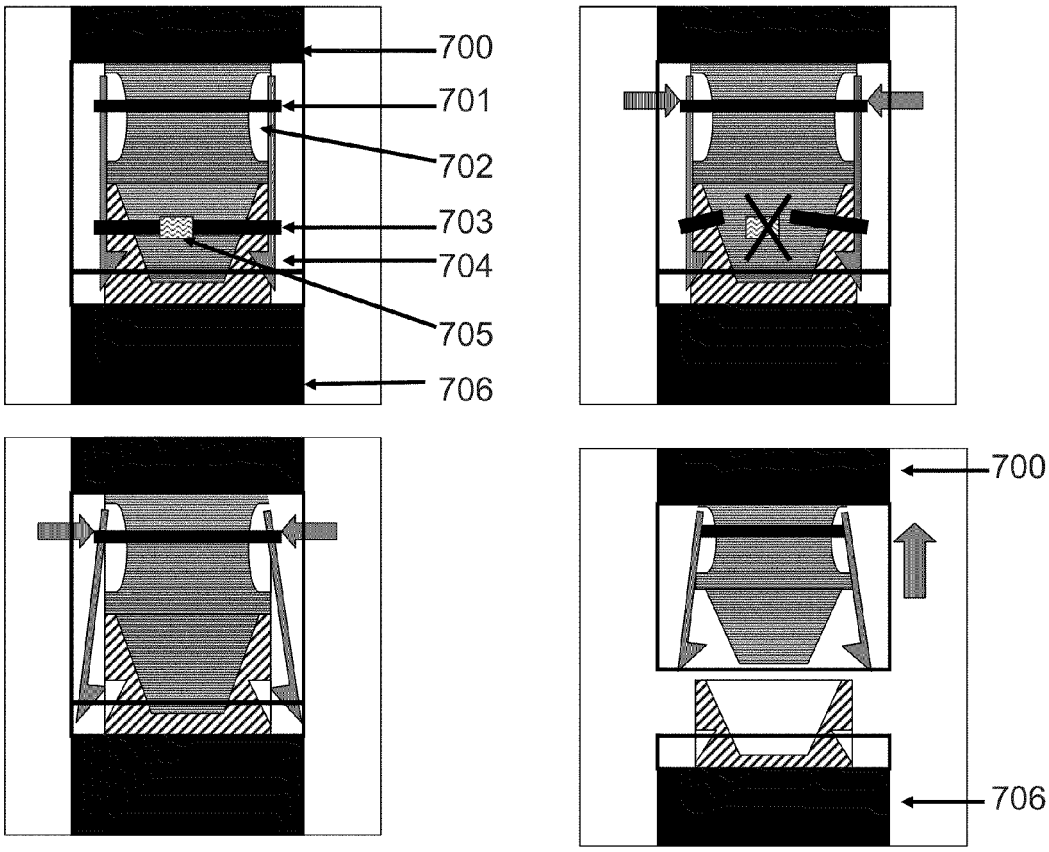
FIG. 7 shows a detaching mechanism that might be used.

FIG. 7 shows an example of a detaching mechanism that might be used to release the upper instrumented tubular section 700 from the lower instrumented tubular section 706 of the instrumented tubular joint by a signal from the surface processing unit. In this particular example, and a person skilled in the art will recognize there are multiple ways to release an assembly to achieve was is needed for the correct operation of the proposed instrumented tubular joint, several locking mechanisms 704 keep the upper instrumented tubular section attached to the lower instrumented tubular section, a spring mechanism 701 exert pressure to the upper part of the locking mechanism 704 but a restrain means 703 keeps the locking mechanism 704 in place. At a signal from the surface processing unit, a remotely operated release assembly 705 releases the restraining means 703 allowing the spring mechanism 701 to release the locking mechanism 704 by pushing the upper part of the locking mechanism 704 into the cavity 702 which in turns allows the locking mechanism 704 to pivot and release the upper instrumented tubular section 700 from the lower instrumented tubular section 706.

Figure 8:
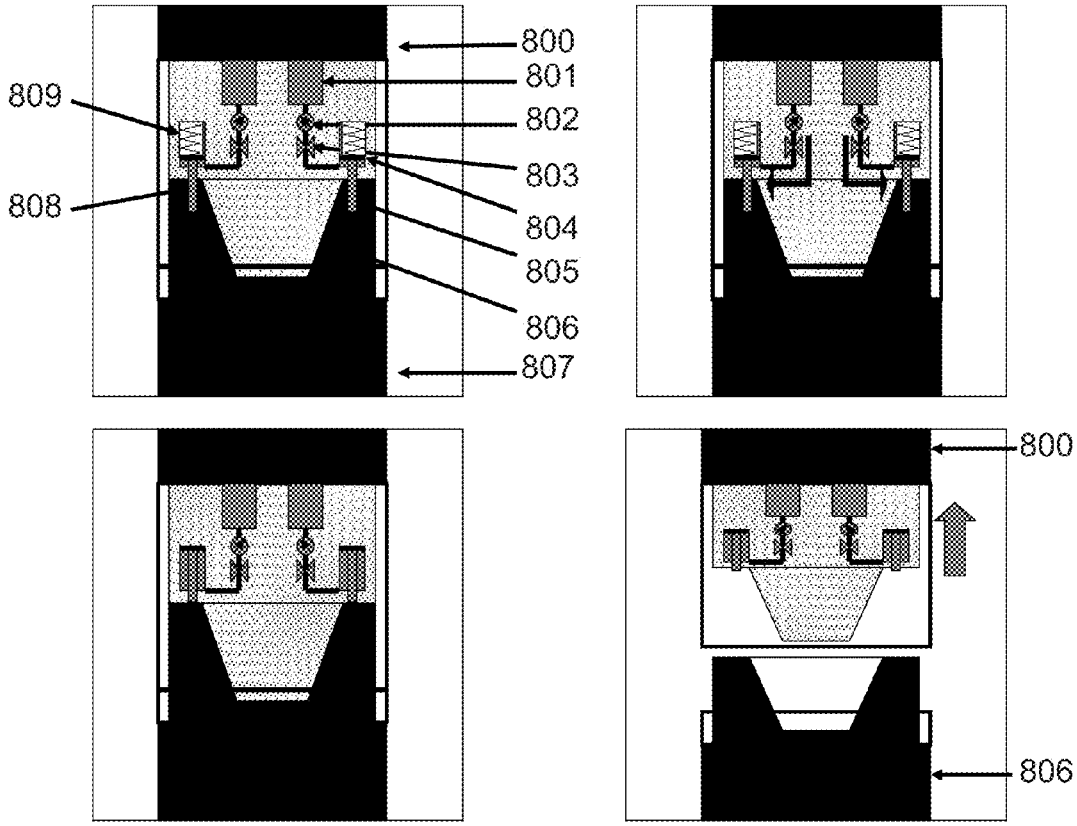
FIG. 8 shows a detaching mechanism that might be used.

FIG. 8 shows an alternative example of a detaching mechanism that might be used to release the upper instrumented tubular section 800 from the lower instrumented tubular section 807 of the instrumented tubular joint by a signal from the surface processing unit. In this particular example, and a person skilled in the art will recognize there are multiple ways to release an assembly to achieve was is needed for the correct operation of the proposed instrumented tubular joint, a spring 809 pushes a piston 804 which in turns drives a rod 808 into a cavity 805 restricting the relative movement between the upper instrumented tubular section 800 and the lower instrumented tubular section 807; the fluid reservoir 801 holds a predetermined amount of fluid that can be pumped to the back of the piston 804 if the diode 803, controlled from the surface processing unit, is in the open position and the pump 802, also controlled from the surface processing unit, is turned on. The pump 802 may be driven by a battery pack (not shown), power from surface or from the downhole controller and data acquisition unit, by increasing the internal pipe or annulus pressure or by similar means a person skilled in the art will be able to recognize. As the fluid is pumped to the back of the piston 804 it moves the rod 808 upwards out of the cavity 805 therefore allowing the movement between the two threaded connections 806 of the upper 800 and lower instrumented tubular sections 807. Generally the pipe used in the industry tightens if a right-hand torque is applied to it and it will loosen if the torque applied if left-handed, the instrumented tubular joint internal threaded connection 806 can be designed to loosen if a right-hand torque is applied so as to avoid the danger of disconnecting a joint other than the desired instrumented tubular joint; by applying a right-hand torque to the entire pipe string all of the pipe's joints will tighten except for the desired instrumented tubular joint which has the rods 808 out of the cavity 805 which will loosen up until is disconnected. At this point the pipe string from the released upper instrumented tubular section 800 up can be retrieved from the borehole. Alternatively the instrumented tubular joint internal threaded connection 806 can be designed with a thread that requires less torque (right or left handed torque) than what is used for the rest of the pipe string.

Figure 9:
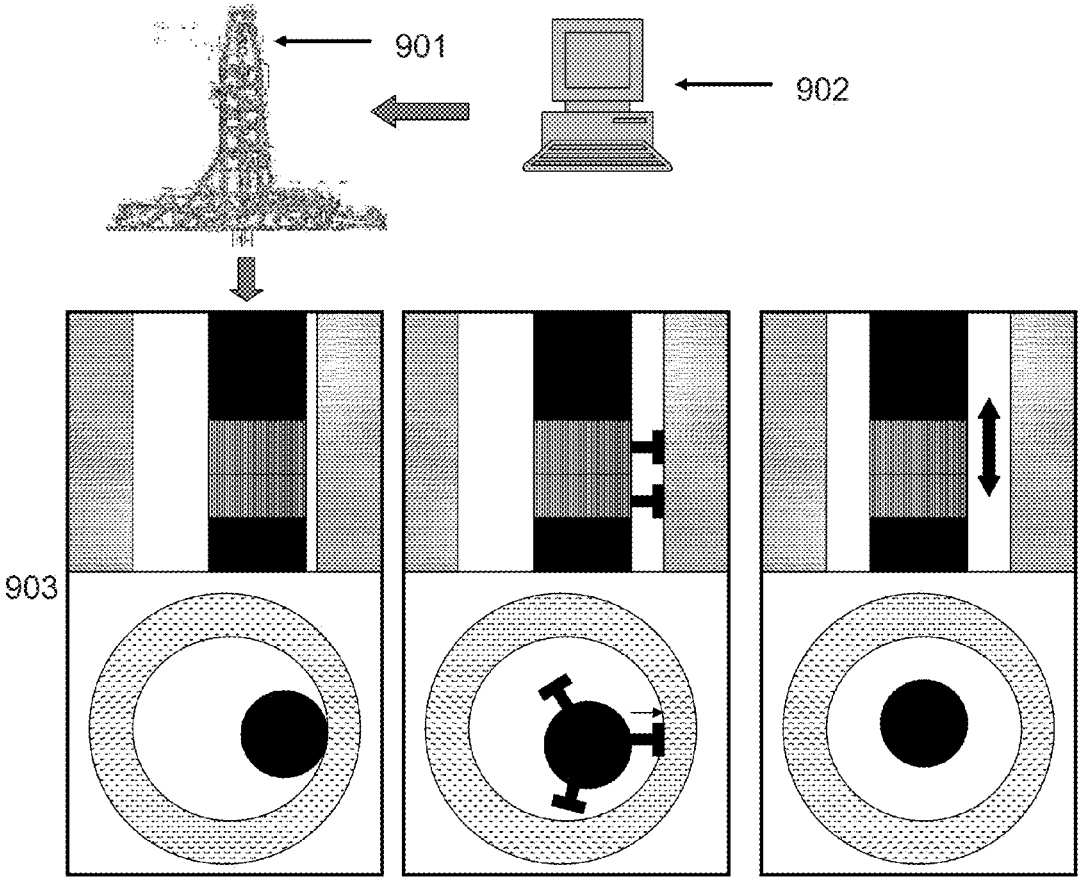
FIG. 9 shows the operation of pushing the pipe away from the borehole wall.

FIG. 9 shows the sequence of events 903, from left to right, where a surface processing unit 902 located in a drilling or work over rig 901 sends a signal to the instrumented tubular joint to operate a mechanism designed to push the instrumented tubular joint away from the borehole wall. The mechanism used to push the instrumented tubular joint away from the borehole wall might be a piston, a telescopic piston, a retractable arm, an inflatable bladder or similar mechanism designed for the purpose of pushing a tubular away from the face of a wall that extends radialy outwards from said instrumented tubular joint apparatus. Such a variety of mechanisms are described extensively in the art. It is desirable to measure the aperture, position in time and movement of the mechanism as it extends outwards from and retracts into the instrumented tubular joint.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present disclosures, the description taken with the drawings making apparent to those skilled in the art how the several forms of the present invention may be embodied in practice. Further, like reference numbers and designations in the various drawings indicated like elements.

While the invention is described through the above exemplary embodiments, it will be understood by those of ordinary skill in the art that modification to and variation of the illustrated embodiments may be made without departing from the inventive concepts herein disclosed. Accordingly, the invention should not be viewed as limited except by the scope of the appended claims.

The invention claimed is:

1. An instrumented tubular joint apparatus for use in a pipe string comprising:

i. An upper tubular section with a threaded connection thereabove and an axial passage for fluid to flow through operatively connected to, ii. A lower tubular section with a threaded connection therebelow and an axial passage for fluid to flow through, iii. A sensor contained in the instrumented tubular joint to measure strain at the instrumented tubular joint, iv. A data recording and transmitting unit operatively connected to the sensor, v. A device to relay the data acquired by the sensor to a surface processing unit;

vi. An extend and retract mechanism which extends against a borehole wall and retracts to loosen the instrumented tubular joint based on a signal received from the surface processing unit;

vii. A plurality of circulating ports which are selectively opened to circulate fluid to loosen the instrumented tubular joint, the extend and retract mechanism and the plurality of circulating ports being located on at least one of the upper tubular section and the lower tubular section; and viii A mechanism to disconnect the upper tubular section from the lower tubular section after receiving a signal from the surface processing unit.

2. An apparatus as in claim 1, wherein the strain measured by the sensor package comprise measuring tension, compression and torsion.

3. An apparatus as in claim 1, wherein said sensor further measures environmental data.

4. An apparatus as in claim 3, wherein the environmental data measured by said sensor comprise temperature, pressure, gas content and fluid viscosity.

5. An apparatus as in claim 1, wherein the lower section of the apparatus after disconnecting from the upper section has a profile which allows a pipe or upper section of said apparatus to be reconnected to said lower section as required.

6. An apparatus as in claim 1, wherein the means to relate said measurements to a surface processing unit comprise wired, wireless, acoustic or optic data transmission means.

7. An instrumented tubular joint apparatus as in claim 1, further comprising:

At least one flow sensor to measure the volume of fluid circulated; and

A mechanism to open and close said circulating ports as required after receiving a signal from a surface processing unit.

8. An apparatus as in claim 7, wherein the fluid volumes measured comprises the volume of fluid circulating through the circulating ports and the fluid circulating inside of the instrumented tubular joint entering at the top of said instrumented tubular joint.

9. An instrumented tubular joint apparatus for use in a pipe string as described in claim 1, further comprising means to push said instrumented tubular joint apparatus away from the borehole wall after receiving a signal from a surface processing unit.

10. An instrumented tubular joint apparatus for use in a pipe string as in claim 9, wherein said means to push said instrumented tubular joint apparatus away from the borehole wall comprises at least one piston, telescopic piston, retractable arm or inflatable bladder that extends radially outwards from said instrumented tubular joint apparatus.

11. An apparatus as described in claim 10, further comprising means to monitor an aperture of said means to push said instrumented tubular joint away from the borehole wall.

12. An apparatus to allow circulating fluid from and to the inside of a pipe and for disconnecting a section of pipe comprising:

i. An upper tubular section operatively connected to a lower tubular section, ii. A plurality of circulating ports in the upper tubular section and in the lower tubular section, the plurality of circulating ports being oriented to direct a treatment fluid into an annulus surrounding the upper and lower tubular sections, iii. sensors to measure strain, fluid volume and environmental data located in the upper or lower tubular section, iv. A data recording and transmitting unit operatively connected to the sensor, v. A relay mechanism to relay the measurements acquired by the sensor to a surface processing unit selected to process the measurements for determining both whether to open or close the circulation ports and to determine whether to disconnect the lower tubular section from the upper tubular section based on the measurements, vi. A mechanism to open and close the plurality of circulating ports and to disconnect the upper tubular section from the lower tubular section as required after receiving a signal from a surface processing unit.

* * * * *